United States Patent [19]

Rosell

[11] 4,363,506

[45] Dec. 14, 1982

[54] LATCH HAVING A RELEASABLE ACTUATING ROD

[75] Inventor: Jean Rosell, "Le Mesnil Sterling", Etalondes 76260 Eu, France

[73] Assignee: La Perche, Escarbotin, France

[21] Appl. No.: 172,829

[22] Filed: Jul. 28, 1980

[30] Foreign Application Priority Data

Jul. 30, 1979 [FR] France ..... 79 19525

[51] Int. Cl.[3] ..... E05C 21/00

[52] U.S. Cl. ..... 292/336.3; 292/DIG. 62

[58] Field of Search ..... 292/336.3, 173, 356, 292/169.12, 169.21, 169.22, 245, DIG. 62

[56] References Cited

U.S. PATENT DOCUMENTS

| | | | |
|---|---|---|---|
| 2,164,290 | 6/1939 | Hurd | 292/169.22 X |
| 3,514,142 | 5/1970 | Smith | 292/113 |
| 4,243,256 | 1/1981 | Frydrych | 292/245 |

*Primary Examiner*—Richard E. Moore
*Attorney, Agent, or Firm*—Irons & Sears

[57] ABSTRACT

The latch comprises a mechanism for actuating at least one bolt comprising a door-knob hub adapted to receive an actuating rod for said mechanism. The latch further comprises an intermediate member which is rotatively mounted in the door-knob hub and ensures the rotatable mounting of the door-knob hub in the case of the latch. The intermediate member comprises an aperture for receiving the actuating rod and is provided with a nose portion for engagement with a branch of the door-knob hub in the course of the rotation of the actuating rod in the direction for actuating the latch. An abutment is provided for stopping the rotation of the nose portion after a given angular displacement of the actuating rod in the direction opposed to the direction for actuating the latch.

3 Claims, 3 Drawing Figures

1
2
3
4
5
6
7
8
10
11
B 3
4
5
7
8
9
10
B 1
2
3
4
5
6
7
8
10
11
B
2
2

LATCH HAVING A RELEASABLE ACTUATING ROD

The present invention relates to latches and more particularly to a latch whose actuating handle must be capable of being rotated freely in the direction opposed to the normal direction for actuating the bolt of the latch.

Handles of doors, windows or other closing elements or leaves are connected to the latches and more particularly to a latch whose actuating handle must be capable of being rotated freely in the direction opposed to the normal direction for actuating the bolt of the latch.

Handles of doors, windows or other closing elements or leaves are connected to the latches by a rigid actuating rod having a square section, one of the ends of the rod being engaged in a handle located on one of the sides of the closing element whereas the other end of the rod is engaged either in the door-knob hub of the latch, or, after having passed through this door-knob hub, in a second handle located on the other side of the closing element.

Some closing elements have an opening frame or a mobile panel forming a shutter, the mounting and dismantling of which require the prior dismantling of the handle located on the side of the closing element on which the frame or panel is mounted.

This is a particular advantage when the handle is formed by an elongated handle which, when it is in its position of rest, extends in a direction perpendicular to the edge of the closing element and consequently hinders the shifting of the frame or panel.

In order to overcome this drawback, it has already been proposed to construct the actuating rod in two parts which are interconnected by a coupling device allowing the part of the actuating rod carrying the elongated handle located on the side corresponding to the frame or panel to be shifted relative to the closing element, to be moved through a quarter of a rotation in the direction opposed to the direction of actuation of the latch so as to place the elongated handle in a vertical position so as to allow the passage of the edge of the frame or panel.

However, an actuating rod of this type has a number of drawbacks.

The device coupling the two parts of the actuating rod has a relatively large volume so that in order to accommodate this device in the closing element a special aperture must be provided for receiving it.

Consequently, the latch is more complicated to mount.

Moreover, an actuating rod provided with a coupling device is very expensive relative to an ordinary actuating rod.

An object of the invention is consequently to overcome the aforementioned drawbacks and to provide a latch whose construction permits the use of a conventional actuating rod and permits freely displacing this actuating rod in the direction opposed to the direction for actuating the latch, through an angle required for the disengagement of the closing element, for the purpose of allowing the shifting of a frame or panel which must be placed on the closing element or withdrawn from the latter.

According to the invention, there is provided a latch comprising an actuating mechanism for actuating at least one bolt comprising a door-knob hub adapted to receive an actuating rod of said mechanism, the latch further comprising an intermediate member mounted to be rotatable in said door-knob hub and ensuring the rotative mounting of the door-knob hub in the case of the latch, said intermediate member comprising an aperture for receiving said actuating rod and being provided with a nose portion adapted to engage with a branch of the door-knob hub in the course of the rotation of the actuating rod in the direction for actuating the latch, and an abutment adapted to prevent the rotation of said nose portion after a given angular displacement of the actuating rod in the direction opposed to the direction for actuating the latch.

Further features and advantages of the invention will be apparent from the ensuing description with reference to the accompanying drawing which is given solely by way of example and in which.

Figure 3:
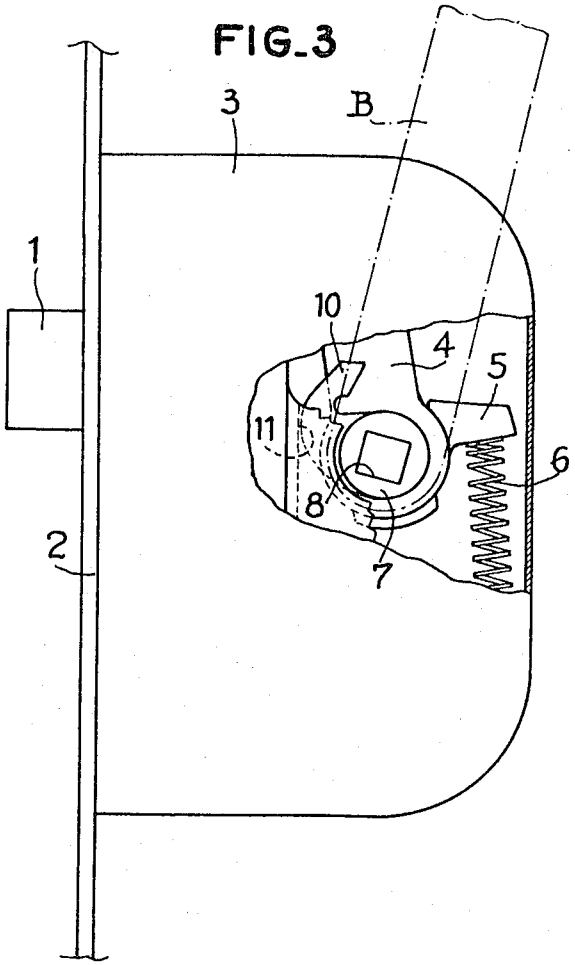
FIG. 3 is a view similar to FIG. 1 showing the elongated handle of the latch in its withdrawn position.

The latch according to the invention comprises a bolt 1 which is mounted to be movable in a direction perpendicular to a head-plate 2 by means of an actuating mechanism disposed in a case 3. This actuating mechanism comprises in particular a door-knob hub 4 mounted to be rotatable in the case 3. This door-knob hub 4 is provided with a branch 5 which is biased by a return spring 6 which returns the door-knob hub to the position of rest.

Figure 2:
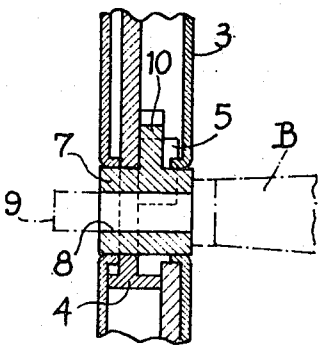
FIG. 2 is a partial sectional view taken on line 2—2 of FIG. 1.

According to the invention, the door-knob hub 4 is rotatively mounted in the case 3 of the latch by means of an intermediate member 7 rotatively mounted in a corresponding aperture formed in the door-knob hub 4, and, as shown in FIG. 2, itself rotatively mounted in the case 3. This intermediate member 7 is formed by a sleeve provided in its centre with a square-section aperture 8 adapted to receive an actuating rod 9 which is shown in fine dot-dash lines in FIG. 2. On the outer face of the sleeve 7 there is formed a nose member 10 which is part of the same material as the sleeve 7 and is adapted to cooperate with the arm 5 of the door-knob hub 4 so as to drive the latter in the direction for actuating the bolt 1.

Provided on a fixed portion rigid with the case 3 is an abutment 11 adapted to stop the rotation of the intermediate member 7 when the latter is displaced through a quarter of a rotation in the direction opposed to the direction of actuation of the bolt 1.

The aforementioned abutment may also be formed by a rod fixed in the case of the latch.

Figure 1:
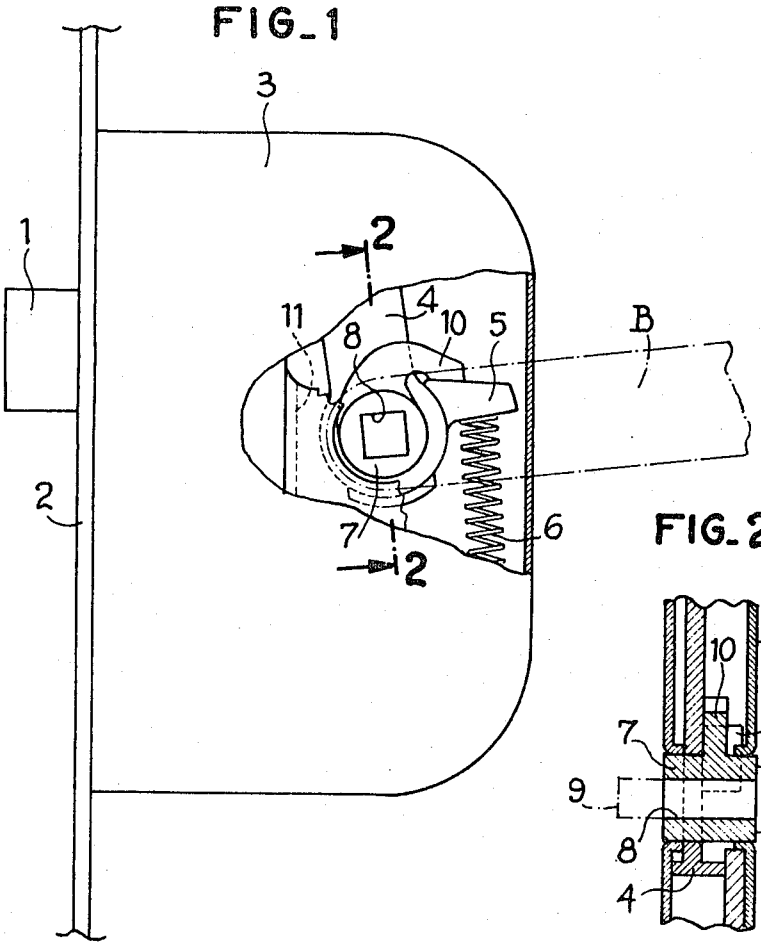
FIG. 1 is an elevational view with a part cut away of a latch according to the invention, the elements of this latch being in the normal position for actuating the bolt.

In FIG. 1, the component elements of the latch are shown in the normal position of actuation of the bolt. It will be observed in this FIG. 1 that the nose portion 10 is engaged with the branch 5 of the door-knob hub 4 and the elongated handle B is in a roughly horizontal position. It is sufficient to depress this elongated handle to shift the bolt 1 away from the keeper therefor.

In FIG. 3, it is seen that the intermediate member 7 has undergone a rotation in the direction opposed to the direction for actuating the bolt which allows placing the elongated handle B in a roughly vertical position. The rear part of the nose portion is prevented from rotating by the abutment 11.

The latch just described has the advantage of incorporating the device for disengaging the actuating rod while having an ordinary outer appearance.

It can be placed in position with no additional operation for adapting the door or window frame adapted to receive it and it allows the use of ordinary square-section actuating rods.

Having now described my invention what I claim as new and desire to secure by Letters Patent is:

1. A latch comprising a case, a mechanism for actuating at least one bolt comprising a door-knob hub, an actuating rod received in the door-knob hub, an intermediate member rotatively mounted in the door-knob hub in the case, which rotatively mounts said door-knob hub the intermediate member having an aperture for receiving the actuating rod and being provided with a nose portion, the door-knob hub having a branch with which the nose portion is capable of engaging when the actuating rod is rotated in a direction for actuating the latch, and an abutment for preventing the rotation of the nose portion after a given angular displacement of the actuating rod in a direction opposed to said direction for actuating the latch.

2. A latch as claimed in claim 1, wherein said abutment is provided on a fixed part rigid with the case of the latch.

3. A latch as claimed in claim 1, wherein the abutment is formed by a rod fixed in the case of the latch.

* * * * *